US009920734B2

(12) United States Patent
Ikemori et al.

(10) Patent No.: US 9,920,734 B2
(45) Date of Patent: Mar. 20, 2018

(54) STARTER

(71) Applicant: Mitsuba Corporation, Kiryu-shi, Gunma (JP)

(72) Inventors: Tomohiko Ikemori, Kiryu (JP); Hiroshi Ooka, Kiryu (JP); Masaaki Oya, Kiryu (JP); Shigehiro Kanbe, Kiryu (JP); Masataka Odagiri, Kiryu (JP); Mitsuhiro Kogure, Kiryu (JP); Hiroki Yamada, Kiryu (JP)

(73) Assignee: Mitsuba Corporation, Gunma (JP)

( * ) Notice: Subject to any disclaimer, the term of this patent is extended or adjusted under 35 U.S.C. 154(b) by 242 days.

(21) Appl. No.: 14/360,602

(22) PCT Filed: Nov. 27, 2012

(86) PCT No.: PCT/JP2012/080570
§ 371 (c)(1),
(2) Date: May 23, 2014

(87) PCT Pub. No.: WO2013/080951
PCT Pub. Date: Jun. 6, 2013

(65) Prior Publication Data

US 2014/0326106 A1 Nov. 6, 2014

(30) Foreign Application Priority Data

Nov. 29, 2011 (JP) ..... 2011-260628
Sep. 27, 2012 (JP) ..... 2012-214247

(51) Int. Cl.
*F02N 15/02* (2006.01)
*F02N 15/06* (2006.01)
*F02N 11/00* (2006.01)

(52) U.S. Cl.
CPC ..... *F02N 15/023* (2013.01); *F02N 11/00* (2013.01); *F02N 15/022* (2013.01); *F02N 15/06* (2013.01); *Y10T 74/134* (2015.01)

(58) Field of Classification Search
CPC .. F02N 11/00; F02N 11/0814; F02N 11/0818; F02N 11/0822; F02N 15/023; F02N 15/022; F02N 15/06; Y10T 74/134
(Continued)

(56) References Cited

U.S. PATENT DOCUMENTS 4,220,808 A * 9/1980 Fujita ..... H02B 1/048 174/490
4,813,808 A * 3/1989 Gehrke ..... F16B 21/16 24/625
(Continued)

FOREIGN PATENT DOCUMENTS

CN 101203673 A 6/2008
JP 5430061 B 9/1979
(Continued)

OTHER PUBLICATIONS

International Search report for PCT/JP2012/080570 application, dated Feb. 19, 2013.
(Continued)

*Primary Examiner* — William C Joyce
(74) *Attorney, Agent, or Firm* — Wood Herron & Evans LLP

(57) ABSTRACT

A starter (1) includes a motor unit (3), an output shaft (4) configured to receive a rotational force of the motor unit (3) and rotate, a pinion gear (74) (a pinion mechanism) helically engageable with a ring gear (23) of an engine, a clutch mechanism (5) configured to transmit the rotational force of the output shaft (4) to the pinion gear (74), and an electromagnetic device (9) configured to bias a pressing force
(Continued)

toward the ring gear (23) to the clutch mechanism (5) and the pinion gear (74), wherein a plunger spring (91) (a backlash absorption mechanism) configured to bring one end (81*a*) (a point of action) of a plunger inner part (81) in constant elastic contact with the clutch mechanism (5) is installed at the electromagnetic device (9).

3 Claims, 9 Drawing Sheets

(58) Field of Classification Search
USPC ..... 74/6, 7 R, 7 A, 7 B, 7 C, 7 E, 8
See application file for complete search history.

(56) References Cited

U.S. PATENT DOCUMENTS 5,018,611 A 5/1991 Hasebe
5,818,118 A * 10/1998 Kimura ..... F02N 15/023 290/48
5,869,913 A * 2/1999 Ohya ..... F02N 15/066 310/154.12
5,893,589 A * 4/1999 Bleitz ..... F16L 37/244 285/148.19
5,894,756 A * 4/1999 Uehara ..... F02N 15/065 192/114 R
5,901,604 A * 5/1999 Sato ..... F02N 15/066 290/38 A
6,157,105 A * 12/2000 Kuragaki ..... F02N 15/023 310/41
6,201,311 B1 * 3/2001 Kamei ..... F02N 15/066 290/38 R
6,268,670 B1 * 7/2001 Kuragaki ..... F02N 15/066 310/75 R
6,269,706 B1 * 8/2001 Kuragaki ..... F02N 15/06 29/596
6,382,037 B1 * 5/2002 Kobayashi ..... F02N 15/066 74/7 A
6,966,330 B2 * 11/2005 Frohwein ..... F16K 24/04 137/202
7,708,489 B2 * 5/2010 Trotter ..... A47C 3/18 403/194
7,857,360 B2 * 12/2010 Lambert ..... F16L 37/098 137/528
9,482,200 B2 * 11/2016 Ikemori ..... F02N 15/00
9,512,812 B2 * 12/2016 Odahara ..... F02N 11/02
9,518,550 B2 * 12/2016 Abe ..... F02N 11/00
2007/0234830 A1 * 10/2007 Ono ..... F02N 15/023 74/7 E
2009/0145263 A1 * 6/2009 Ono ..... C23C 8/26 74/7 C
2009/0200796 A1 * 8/2009 Lai ..... F16L 37/098 285/317
2009/0250942 A1 * 10/2009 Odagiri ..... F02N 15/066 290/38 R
2010/0257975 A1 * 10/2010 Niimi ..... F02N 11/087 74/7 C
2010/0264670 A1 * 10/2010 Usami ..... F02N 11/0844 290/38 R
2010/0294078 A1 * 11/2010 Ono ..... C23C 8/26 74/7 C
2011/0193434 A1 * 8/2011 Kaske ..... F16D 1/116 310/83
2013/0133479 A1 * 5/2013 Ikemori ..... F02N 15/046 74/7 C

FOREIGN PATENT DOCUMENTS

JP 60039493 Y 11/1985
JP 02119675 A 5/1990
JP 2002130097 A 5/2002
JP 2006161590 A 6/2006
JP 2007071043 A 3/2007
JP 2010048130 A 3/2010

OTHER PUBLICATIONS

The State Intellectual Property Office of the Peoples Republic of China, Notice on the First Office Action, issued in corresponding Chinese Patent Application No. 201280057683.3 and English-language translation, dated Sep. 6, 2015.
Japanese Patent Office, Notice of Allowance Issued in Japanese Patent Application No. 2012214247 dated Jun. 7, 2016, 6 pages.

* cited by examiner

STARTER

TECHNICAL FIELD

The present invention relates to, for example, a starter mounted on an automobile.

Priority is claimed on Japanese Patent Application Nos. 2011-260628, filed Nov. 29, 2011, and 2012-214247, filed Sep. 27, 2012, the contents of which are incorporated herein by reference.

BACKGROUND ART

In the related art, as a starter used to start an automobile, a jump-in type starter configured to jump a pinion gear toward a ring gear to be meshed with the ring gear upon starting an engine and drive the ring gear by the pinion gear to start the engine is known (for example, see Patent Literature 1).

In addition, in recent years, in order to increase silence or fuel efficiency of a vehicle, vehicles having a so-called idle stop function of switching an engine to be turned off when the vehicles are temporarily stopped have increased.

A starter disclosed in Patent Literature 1 is configured to be applied to the vehicle having the above-mentioned idle stop function. In the starter disclosed in Patent Literature 1, a drive shaft (an output shaft) is connected to a rotor shaft of a starting motor via a planetary gear type reduction gear. The drive shaft has both end sides in an axial direction, which are rotatably axially supported by a housing of the starter. A needle configured to advance and retreat via a lever (a gear plunger) by a magnet switch (an electromagnetic device) in the axial direction is spline-engaged with the drive shaft. In addition, a pinion gear configured to freely advance and retreat with respect to a ring gear in the axial direction is installed at the drive shaft, and is connected to the needle via a one-way clutch (a clutch mechanism).

Upon starting the engine, the pinion gear is jumped toward the ring gear to be meshed with the ring gear by the magnet switch via the lever, the needle and the one-way clutch, and rotation of the motor unit is transmitted to the pinion gear via a speed reduction mechanism to drive the ring gear. The ring gear and the pinion gear are configured of helical teeth (helical gears). A torsion direction of the teeth of the ring gear and the pinion gear is set such that a thrust load in a jump-in direction is applied to the pinion gear in a state in which the pinion gear drives the ring gear.

According to Patent Literature 1, when the pinion gear is meshed with the ring gear, the pinion gear receives a thrust load generated by a helix angle of the teeth of both gears to naturally advance in the jump-in direction. For this reason, a meshing property of the pinion gear with respect to the ring gear is improved.

However, components of the starter of a clutch mechanism, a pinion gear, and so on, have dimensional errors upon manufacture. For this reason, in the above-mentioned starter, when the pinion gear is meshed with the ring gear upon starting the engine, an aperture is generated between a point of action of the electromagnetic device and the clutch mechanism.

Here, when the lever (the gear plunger) is set to be attracted to a maximum attraction position and held by the magnet switch (the electromagnetic device), if no aperture is provided, in the case in which the lever is shaken in a direction in which a dimensional error of a part is large due to the error, the lever (the gear plunger) may not be attracted to the maximum attraction position and held. The above-mentioned aperture is generated by setting the dimension of each part through addition of the error upon design.

In a starter of Patent Literature 2, a second plunger unit is disposed to advance and retreat in an axial direction by a magnet switch (an electromagnetic device) concentrically with a drive shaft (an output shaft). A pinion gear is installed at the drive shaft to advance and retreat with respect to a ring gear in an axial direction.

CITATION LIST

Patent Literature

[Patent Literature 1] Japanese Unexamined Patent Application, First Publication No. 2002-130097

[Patent Literature 2] Japanese Unexamined Patent Application, First Publication No. 2007-71043

SUMMARY OF INVENTION

Technical Problem

Here, since the pinion gear and the ring gear are helically engaged, a direction of the thrust load applied to the pinion gear is varied based on a rotational speed difference between the pinion gear and the ring gear upon starting the engine. Specifically, when a rotational speed of the ring gear is lower than that of the pinion gear, the thrust load is applied to the pinion gear toward the ring gear, and the pinion gear is displaced toward the ring gear. In addition, when the rotational speed of the ring gear is higher than that of the pinion gear, the thrust load is applied to the pinion gear toward an opposite side of the ring gear, and the pinion gear is displaced toward the opposite side of the ring gear.

From this state, when the rotational speed of the previous ring gear is lower than that of the pinion gear and the pinion gear is rotated by a rotational force of a motor unit (an armature), there is backlash between the lever (the gear plunger) and the clutch mechanism, and the clutch mechanism is displaced in the axial direction to the extent of the backlash. For this reason, transmission of the rotational force of the motor unit (the armature) to the pinion gear is slightly delayed to that extent. Further, a load applied to the rotation of the motor unit (the armature) is also reduced while the clutch mechanism moves to the extent of the backlash. For this reason, the rotation of the motor unit (the armature) starts to accelerate. However, when the backlash is blocked, the load is applied to the rotation of the motor unit (the armature) to be transited from the acceleration state to a constant speed state. According to a variation of the state, irregularity in the rotation of the motor unit (the armature) may occur, and gearing sound between the gears of the reduction mechanism may be generated by the irregularity of the rotation.

In particular, in the vehicle having the idle stop function, a key cylinder is manipulated by a user's intention upon starting of the conventional engine. For this reason, since engine starting sound (starter operating sound) refers to audibly recognizable starting of the engine, the sound is not particularly a problem. However, upon re-departure of the vehicle after temporary stoppage, restarting of the engine in the stoppage state is performed regardless of the user's intention. For this reason, needs to silence of the engine starting sound (the starter operating sound) are increased. In this way, in the vehicle having the idle stop function, stoppage/starting of the engine is frequently performed, and a frequency of use is increased in comparison with a conventional starter. For this reason, the best remedy with respect to the above-mentioned problems is required.

The present invention is directed to provide a starter capable of preventing generation of an aperture between a point of action of an electromagnetic device and a clutch mechanism, preventing shaking of the clutch mechanism, and suppressing generation of noises.

Solution to Problem

According to a first aspect of the present invention, a starter includes a motor unit configured to generate a rotational force rotational force by conducting electricity; an output shaft configured to receive the rotational force of the motor unit and rotate; a pinion mechanism slidably installed on the output shaft and helically engageable with a ring gear of an engine; a clutch mechanism installed between the output shaft and the pinion mechanism and configured to transmit the rotational force of the output shaft to the pinion mechanism; and an electromagnetic device configured to perform conducting electricity and blocking electricity to the motor unit and bias a pressing force toward the ring gear to the clutch mechanism and the pinion mechanism, and having an exciting coil and a gear plunger sliding in the output shaft direction based on application of an electric current to the exciting coil and configured to bias a pressing force to the clutch mechanism. The clutch mechanism includes a clutch outer part disposed at the gear plunger side, and a clutch inner part disposed inside in the radial direction of the clutch outer part, concentrically with the clutch outer part and integrally formed with the pinion inner part. Further, a backlash absorption mechanism configured to elastic contact a point of action of the gear plunger with the clutch outer part in constant is installed at the electromagnetic device.

According to the starter of the first aspect of the present invention, since the backlash absorption mechanism configured to bring a point of action of the gear plunger in constant elastic contact with the clutch outer part is provided, generation of an aperture between the point of action of the gear plunger and the clutch outer part can be prevented. Accordingly, upon starting the engine, even when the pinion mechanism is displaced in the axial direction by a difference in rotational speed between the ring gear and the pinion mechanism, the clutch mechanism can be suppressed from being shaken in the axial direction. Accordingly, generation of noises caused by displacement in the axial direction of the clutch mechanism can be prevented.

In addition, as the pinion inner part and the clutch inner part are integrally formed, the starter can be formed at a low cost.

According to a second aspect of the present invention, in the starter according to the first aspect of the present invention, the pinion mechanism includes a pinion inner part fitted onto the output shaft and slidable along the output shaft; a pinion gear concentrically installed with the pinion inner part and helically engageable with the ring gear, outside in a radial direction of the pinion inner part; and a pinion spring disposed between the pinion inner part and the pinion gear and configured to absorb shock when the pinion gear and the ring gear are helically engaged.

According to the starter of the second aspect of the present invention, since the pinion mechanism includes the pinion spring, shock can be absorbed when the pinion gear and the ring gear come in contact. Accordingly, in addition to an effect obtained by the starter according to the first aspect of the present invention, wear between the pinion gear and the ring gear can be suppressed, and durability of the starter can be improved.

In addition, as absorption of the shock is performed by the pinion spring and absorption of the backlash of the clutch mechanism is performed by the backlash absorption mechanism, functions of the pinion spring and the backlash absorption mechanism are separated. For this reason, elastic moduli of the pinion spring and the backlash absorption mechanism can be optimally set. Accordingly, the starter having good durability and silence can be obtained.

According to a third aspect of the present invention, in the starter according to the first aspect or the second aspect of the present invention, the gear plunger includes a gear plunger concentrically installed with the output shaft and configured to bias a pressing force to the clutch mechanism as the gear plunger slides along the output shaft based on conducting electricity to the exciting coil. Further, the point of action is formed at an end section of the gear plunger near the ring gear.

According to a third aspect of the present invention, in the starter according to the first aspect or the second aspect of the present invention, the a gear plunger concentrically installed with the output shaft, slidable along the output shaft based on conducting electricity to the exciting coil, and configured to bias a pressing force to the clutch mechanism. Further, the point of action is formed at an end section of the gear plunger near the ring gear.

According to a fourth aspect of the present invention, in the starter according to the third aspect of the present invention, the gear plunger includes a plunger inner part fitted onto the output shaft and slidable along the output shaft; a plunger outer part separately from the plunger inner port, installed concentrically with the plunger inner part, outside in the radial direction of the plunger inner part, and interlocked with the plunger inner part to be slidable along the output shaft; and a plunger spring installed between the plunger inner part and the plunger outer part. Further, the plunger outer part is slidable based on conducting electricity to the exciting coil and the plunger inner part is interlocked with slide movement of the plunger outer part to be slidable. And, the plunger spring functions as the backlash absorption mechanism.

According to the starter of the fourth aspect of the present invention, as the plunger spring is used, the shaking absorption mechanism can be formed with a simple structure at a low cost.

Furthermore, since the plunger inner part can elastically abut the clutch outer part by the plunger spring, the backlash absorption mechanism can be formed with a simple structure at a low cost.

Furthermore, according to a sixth aspect of the present invention, in the starter according to the third aspect or the fourth aspect of the present invention, provided that a spring load of the plunger spring is $\alpha$ and an attractive force generated at the plunger outer part by a magnetic field generated through conducting electricity to the exciting coil of the electromagnetic device is $\beta$, the spring load $\alpha$ and the attractive force $\beta$ of the electromagnetic device are set to satisfy $\alpha<\beta$.

According to the starter of the sixth aspect of the present invention, the spring load of the plunger spring that configures the backlash absorption mechanism is set to be smaller than the attractive force of the electromagnetic device. For this reason, the point of action of the electromagnetic device can elastically abut the clutch mechanism while securely attracting the gear plunger against the spring load of the plunger spring. Accordingly, the clutch mechanism can be suppressed from being shaken in the axial direction by the backlash absorption mechanism while maintaining attraction performance of the electromagnetic device.

Furthermore, according to a seventh aspect of the present invention, in the starter according to any one of the third aspect, the fourth aspect and the sixth aspect of the present invention, the plunger inner part abuts the clutch outer part, a pressing force is biased to the pinion mechanism via the clutch outer part, and an outer flange section is formed at one end of the plunger inner part. Further, an inner flange section is formed at one end of the plunger outer part, and the plunger spring is put in a spring housing unit formed between the inner flange section and the clutch outer part. Further, the plunger spring is a coil spring concentrically fitted onto the plunger inner part. Further, a winding direction of the plunger spring toward the clutch mechanism is the same as a rotation direction of the pinion mechanism.

According to the starter of the seventh aspect of the present invention, the winding direction of the plunger spring toward the clutch mechanism is set to be the same as a rotation direction of the pinion mechanism. For this reason, the end surface of the plunger spring near the clutch mechanism is disposed to face the rotation direction of the pinion mechanism. Accordingly, even when the clutch mechanism and the plunger inner part in sliding contact therewith are rotated with the clutch mechanism, a circumferential edge of the end surface of the plunger spring can be suppressed from being hooked by the outer circumferential surface of the plunger inner part. Accordingly, wear of the outer flange section of the plunger inner part and the inner surface side of the inner flange of the plunger outer part can be prevented by the circumferential edge of the end surface of the plunger spring. As a result, the starter having good durability can be obtained.

According to an eighth aspect of the present invention, in the starter according to the seventh aspect of the present invention, a claw section protruding outward in the radial direction and elastically deformable inward in the radial direction is formed at the plunger inner part at a position corresponding to the inner flange section of the plunger outer part. Further, the inner flange section is engaged with the claw section. Further, a gap between an inner circumferential surface of the claw section and an outer circumferential surface of the output shaft is set to be smaller than a height of the claw section.

The plunger inner part and the plunger outer part can be simply integrated through snap fitting. Accordingly, since the gear plunger can be simply formed, the starter can be obtained at a low cost.

In addition, the gap between the inner circumferential surface of the claw section and the outer circumferential surface of the output shaft is set to be smaller than the height of the claw section. For this reason, as the plunger inner part and the plunger outer part are integrated and then fitted onto the output shaft, displacement of the claw section inward in the radial direction exceeding the height is restricted by the outer circumferential surface of the output shaft. Accordingly, since release of the engagement by the snap fitting between the plunger inner part and the plunger outer part can be securely prevented, the starter having high reliability can be obtained.

According to a ninth aspect of the present invention, in the starter according to any one of the first aspect to the fourth aspect and the sixth aspect to the eighth aspect of the present invention, the electromagnetic device is concentrically formed with the output shaft.

According to the starter of the ninth aspect of the present invention, the present invention can be applied to a so-called uniaxial type starter in which the electromagnetic device and the output shaft are concentrically installed. Accordingly, even in the uniaxial type starter, collision between the point of action of the electromagnetic device and the clutch mechanism can be prevented. As a result, generation of noises can be prevented.

Advantageous Effects of Invention

According to the present invention, since the backlash absorption mechanism in which the point of action of the electromagnetic device always elastically abuts the clutch mechanism is installed, generation of the aperture between the point of action of the electromagnetic device and the clutch mechanism can be prevented. Accordingly, upon starting the engine, even when the pinion mechanism is displaced in the axial direction by the rotational speed difference between the ring gear and the pinion mechanism, shaking of the clutch mechanism in the axial direction can be suppressed. Accordingly, generation of noises due to the displacement in the axial direction of the clutch mechanism can be prevented.

EMBODIMENTS OF INVENTION

Hereinafter, a starter according to an embodiment of the present invention will be described with reference to the accompanying drawings.

Figure 1:
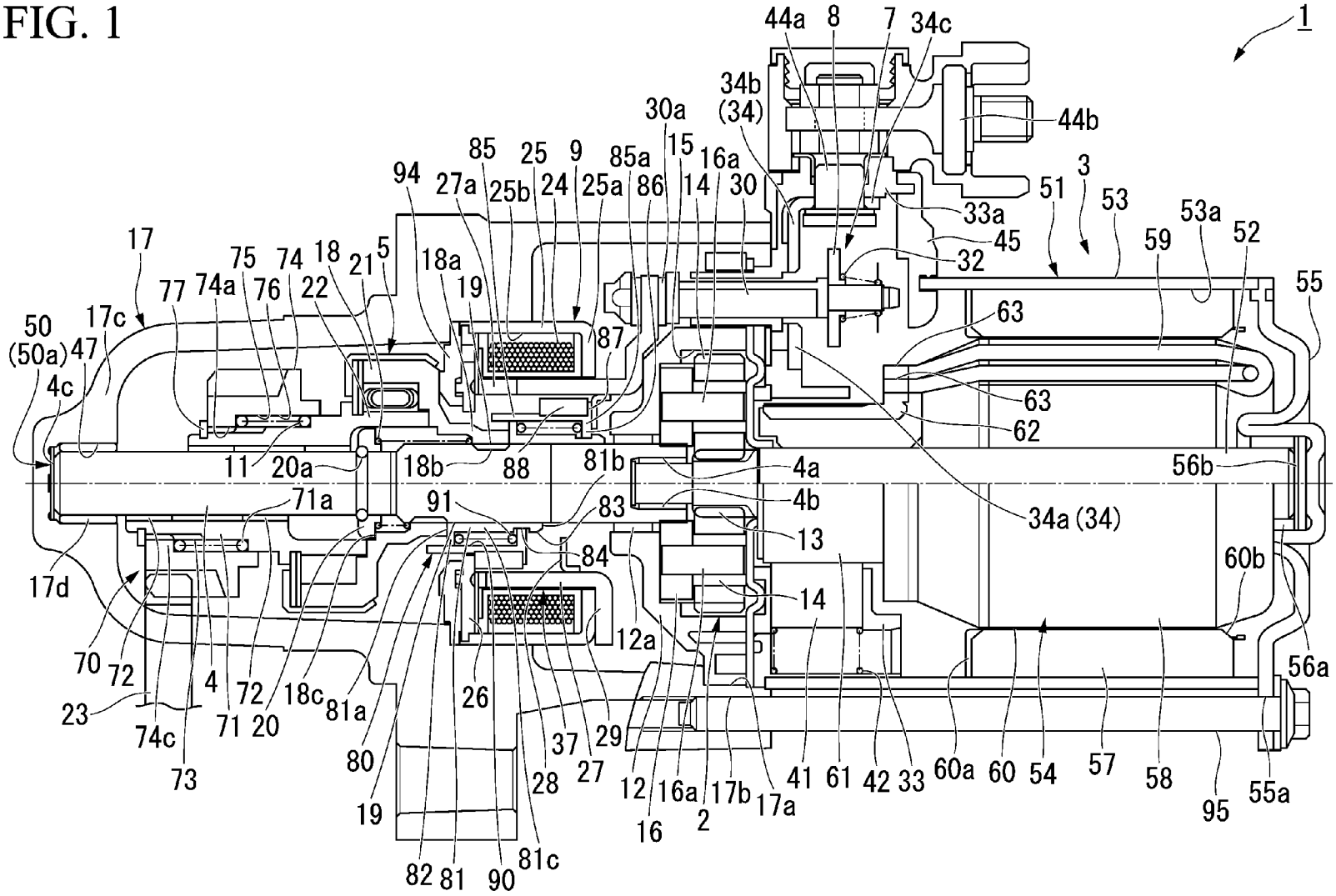
FIG. 1 is a cross-sectional view of a starter according to an embodiment of the present invention.

FIG. 1 is a cross-sectional view of a starter 1 according to the embodiment. In FIG. 1, a stopped state of the starter 1 is shown at an upper side over a centerline and an electrically connected state of the starter 1 (a state in which a pinion gear is meshed with a ring gear) is shown at a lower side.

As shown in FIG. 1, the starter 1 is an apparatus for generating a rotational force needed to start an engine (not shown). The starter 1 includes a motor unit 3, an output shaft 4 connected to one side (a left side of FIG. 1) of the motor unit 3, a clutch mechanism 5 and a pinion mechanism 70 slidably installed on the output shaft 4, a switch unit 7 configured to open and close a power supply path with respect to the motor unit 3, and an electromagnetic device 9 configured to move a movable contact plate 8 of the switch unit 7 and the pinion mechanism 70 in an axial direction.

The motor unit 3 is configured of a brush-attached direct current motor 51 and a planetary gear mechanism 2 connected to the rotary shaft 52 of the brush-attached direct current motor 51 and configured to transmit a rotational force of the rotary shaft 52 to the output shaft 4.

The brush-attached direct current motor 51 has a substantially cylindrical motor yoke 53 and an armature 54 disposed inside in the radial direction of the motor yoke 53 and installed rotatable with respect to the motor yoke 53. A plurality of (in the embodiment, six) permanent magnets 57 are installed at an inner circumferential surface of the motor yoke 53 such that magnetic poles are alternately disposed in the circumferential direction.

A magnet cover 60 is installed inside in the radial direction of the permanent magnet 57. The magnet cover 60 is a substantially cylindrical member, which is formed of a non-magnetic material such as stainless steel or the like.

An outer flange section 60*a* overhanging outward in the radial direction is formed at one side (a left side of FIG. 1) of the magnet cover 60. The outer flange section 60*a* covers an end surface of one side of the permanent magnet 57.

In addition, a swaging section 60*b* inclined outward in the radial direction from one side to the other side is formed at the other side (a right side of FIG. 1) of the magnet cover 60. The magnet cover 60 is swaged and fixed to the inside in the radial direction of the permanent magnet 57. The motor yoke 53 is reinforced as the magnet cover 60 is installed, and strength of a yoke unit configured of the motor yoke 53, the permanent magnet 57 and the magnet cover 60 is improved.

An end plate 55 configured to cover an opening section 53*a* of the motor yoke 53 is formed at an end section of the other side (a right side of FIG. 1) of the motor yoke 53. A slide bearing 56*a* configured to rotatably support the other end of the rotary shaft 52 and a thrust bearing 56*b* are installed at a center in the radial direction of the end plate 55.

The armature 54 is configured of the rotary shaft 52, an armature core 58 fitted onto and fixed to the rotary shaft 52 at a position corresponding to the permanent magnet 57, and a commutator 61 fitted onto and fixed to the rotary shaft 52 closer to the planetary gear mechanism 2 (a left side of FIG. 1) than the armature core 58.

The armature core 58 has a plurality of teeth (not shown) formed in a radial shape, and a plurality of slots (not shown) formed between the neighboring teeth in the circumferential direction. A coil 59 is wound between the slots formed in the circumferential direction at predetermined intervals through, for example, wave winding. A terminal section of the coil 59 is pulled toward the commutator 61.

A plurality of (for example, in the embodiment, 26) segments 62 are formed at the commutator 61 at predetermined intervals in the circumferential direction to be electrically insulated from each other.

A riser 63 curved to be turned back is formed at an end of each of the segments 62 near the armature core 58. A terminal section of the coil 59 wound on the armature core 58 is connected to the riser 63.

A tubular top plate 12 having a bottom section is formed on an opposite side from the end plate 55 of the motor yoke 53. The planetary gear mechanism 2 is installed at an inner surface of the top plate 12 near the armature core 58.

The planetary gear mechanism 2 is configured of a sun gear 13 integrally formed with the rotary shaft 52, a plurality of planetary gears 14 meshed with the sun gear 13 and revolving about the sun gear 13, and an annular internal teeth ring gear 15 installed at outer circumferences of the planetary gears 14.

The plurality of planetary gears 14 are connected by a carrier plate 16. A plurality of support shafts 16*a* are stood up at the carrier plate 16 at positions corresponding to the planetary gears 14. The planetary gears 14 are rotatably supported at the plurality of support shafts 16*a*. In addition, the output shaft 4 is meshed with a center in the radial direction of the carrier plate 16 through serration engagement.

The internal teeth ring gear 15 is integrally formed with the inner circumferential surface of the top plate 12 near the armature core 58. A slide bearing 12*a* is installed at a center in the radial direction of the inner circumferential surface of the top plate 12. The slide bearing 12*a* rotatably supports the other end (a right side end of FIG. 1) of the output shaft 4 disposed concentrically with the rotary shaft 52.

In addition, the output shaft 4, the clutch mechanism 5, the pinion mechanism 70, the electromagnetic device 9, and so on, are installed in the top plate 12, and a housing 17 formed of aluminum and configured to fix the starter 1 to the engine (not shown) is mounted on the top plate 12. The housing 17 is formed in a bottomed cylindrical shape through die cast molding, and has a bottom section 17*c* formed at one side (a left side of FIG. 1) and an opening section 17*a* formed at the other side (a right side of FIG. 1).

The top plate 12 is attached to a side of the housing 17 near the opening section 17*a* to cover the opening section 17*a*.

A female screw section 17*b* is formed at the outer circumferential surface of the housing 17 near the opening section 17*a* in the axial direction. In addition, a bolt hole 55*a* is formed at the end plate 55 disposed at the other side (a right end side of FIG. 1) of the motor yoke 53 at a position corresponding to the female screw section 17*b*. As a bolt 95 is inserted into the bolt hole 55*a* and the bolt 95 is threadedly engaged with the female screw section 17*b*, the motor unit 3 and the housing 17 are integrated with each other.

A ring-shaped stopper 94 configured to restrict displacement of a clutch outer part 18 (to be described below) toward the motor unit 3 is installed at an inner wall of the housing 17. The stopper 94 is formed by a resin, rubber, or the like. The stopper 94 attenuates an impact upon abutment of the clutch outer part 18.

A bearing hole 47 having a bottom section is formed at the bottom section 17*c* of the housing 17 to be concentric with the output shaft 4. An inner diameter of the bearing hole 47 is larger than an outer diameter of the output shaft 4. A slide bearing 17*d* configured to rotatably support one end (a left side end of FIG. 1) of the output shaft 4 is fitted into and fixed to the bearing hole 47. A lubricant formed of a desired base oil is impregnated in the slide bearing 17*d* and smoothly comes in slide contact with the output shaft 4.

In addition, in the bottom section of the bearing hole 47, a load receiving member 50 is disposed between the bottom section 17*c* of the housing 17 and one end surface 4*c* of the output shaft 4.

The load receiving member 50 is a flat plate-shaped metal member. A ring-shaped washer formed through, for example, pressing is employed in the load receiving member 50. The load receiving member 50 is formed of a material having good abrasion resistance and hardness higher than that of the output shaft 4. For example, carbon tool steel such as SK85 or the like is appropriate as a material of the load receiving member 50.

As the load receiving member 50 is disposed, even when a thrust load is generated at the output shaft 4 toward the one side (a left side of FIG. 1), the thrust load of the output shaft 4 can be received while restricting movement of the output shaft 4 at the load receiving member 50 installed at the housing 17. In addition, upon rotation of the output shaft 4, since the one end surface 4*c* of the output shaft 4 comes in slide contact with the load receiving member 50, direct slide contact between the one end surface 4*c* of the output shaft 4 and the housing 17 can be prevented. Accordingly, durability of the housing 17 is improved.

Further, grease for reducing friction with the one end surface 4*c* of the output shaft 4 upon sliding contact is applied around the load receiving member 50. Since the grease including the same kind of base oil as the lubricant impregnated in the slide bearing 17*d* is employed, the lubricant of the slide bearing 17*d* can be held for a long time.

A concave section 4*a* into which one end (a left side end of FIG. 1) of the rotary shaft 52 can be inserted is formed at the other end (a right side end of FIG. 1) of the output shaft 4. A slide bearing 4*b* is press-fitted into the inner circumferential surface of the concave section 4*a*. The output shaft 4 and the rotary shaft 52 are relatively rotatably connected to each other.

(Clutch Mechanism)

A helical spline 19 is formed at substantially a center in the axial direction of the output shaft 4. The clutch mechanism 5 is helically engaged with the helical spline 19.

The clutch mechanism 5 includes the clutch outer part 18 having a substantially cylindrical shape, and a clutch inner part 22 formed concentrically with the clutch outer part 18. A so-called one-way clutch function configured to transmit a rotational force from the clutch outer part 18 side to the clutch inner part 22 and configured not to transmit a rotational force from the clutch inner part 22 side to the clutch outer part 18 is installed at the clutch mechanism 5. Accordingly, upon starting the engine, when an overrun state in which a speed of the clutch inner part 22 side is higher than that of the clutch outer part 18 occurs, a rotational force from a ring gear 23 side of the engine is blocked. In addition, the clutch mechanism 5 also includes a torque limiter function of transmitting a mutual rotational force when a torque difference generated between the clutch outer part 18 and the clutch inner part 22 and a rotational speed difference are a predetermined value or less, and blocking transmission of the rotational force when the torque difference and the rotational speed difference exceed the predetermined value.

A diameter-reduced sleeve 18*a* is integrally formed at the other side (the right side of FIG. 1) of the clutch outer part 18. A helical spline 18*b* meshed with the helical spline 19 of the output shaft 4 is formed at the inner circumferential surface of the sleeve 18*a*. Accordingly, the clutch mechanism 5 is installed with respect to the output shaft 4 to be slidable in the axial direction. Further, an inclination angle between the helical spline 19 of the output shaft 4 and the helical spline 18*b* of the clutch outer part 18 is set to, for example, about 16° with respect to the axial direction.

In addition, a stepped section 18*c* is formed at one side of the sleeve 18*a* of the inner circumferential surface of the clutch outer part 18. The inner circumferential surface of the stepped section 18*c* has a larger diameter than the inner circumferential surface of the sleeve 18*a*, and a space is formed between the inner circumferential surface of the stepped section 18*c* and the outer circumferential surface of the output shaft 4. A return spring 21 (to be described below) is disposed in the space.

A movement restriction section 20 is formed at one side (the left side of FIG. 1) of the output shaft 4 farther than the helical spline 19.

The movement restriction section 20 is a substantially ring-shaped member fitted onto the output shaft 4. The movement restriction section 20 is formed in a state in which movement toward one side in the axial direction is restricted by a circlip 20*a*. Further, the movement restriction section 20 has a larger diameter than the inner circumferential surface of the stepped section 18*c* to enable interference with the stepped section 18*c* formed at the clutch outer part 18. As described below, when the clutch mechanism 5 is slid to one side, the stepped section 18*c* of the clutch outer part 18 and the movement restriction section 20 interfere with each other. Accordingly, a slide moving amount of the clutch mechanism 5 to one side is restricted.

The return spring 21 configured to surround the output shaft 4 is formed in a compressed and deformed state between the movement restriction section 20 and the sleeve 18*a* of the clutch outer part 18 and between the inner circumferential surface of the stepped section 18*c* and the outer circumferential surface of the output shaft 4. Accordingly, the clutch outer part 18 is always biased to be pushed back toward the motor unit 3.

In the clutch mechanism 5 having the above-mentioned configuration, the pinion mechanism 70 is integrally formed with a distal end of the clutch inner part 22.

(Pinion Mechanism)

The pinion mechanism 70 has a tubular pinion inner part 71 integrally formed with the distal end of the clutch inner part 22. Two slide bearings 72 and 72 configured to slidably support the pinion inner part 71 by the output shaft 4 are installed at the inner circumferential surface of the pinion inner part 71 at both sides in the axial direction.

A spline 73 is formed at a distal end side of the outer circumferential surface of the pinion inner part 71 opposite to the clutch mechanism 5. A pinion gear 74 configured to mesh with the ring gear 23 of the engine (not shown) is spline-fitted to the spline 73. That is, while the spline 73 is formed at the distal end side of the pinion inner part 71, a spline 74*a* meshed with the spline 73 is formed at the distal end side of the inner circumferential surface of the pinion gear 74. Accordingly, the pinion inner part 71 and the pinion gear 74 are in a relatively non-rotatable state and an axially slidable state.

Here, the ring gear 23 and the pinion gear 74 are configured of helical teeth (helical gears). A helical direction of the teeth of the ring gear 23 and the pinion gear 74 is set such that a thrust load in the jump-in direction is applied to the pinion gear 74 in a state in which the pinion gear 74 drives the ring gear 23.

Furthermore, a diameter-enlarged section 75 having a diameter enlarged via a step difference section 74*c* is formed at the inner circumferential surface of the pinion gear 74 near a rear end of the spline 74*a*. A housing unit 76 is formed between the pinion inner part 71 and the pinion gear 74.

An opening section formed at the housing unit 76 near the clutch mechanism 5 is closed by a step difference section 71*a* formed at a base end side of the clutch inner part 22. That is, the pinion gear 74 is supported by the pinion inner part 71 to be slidable in the axial direction. Accordingly, the pinion gear 74 is slid in the axial direction without much shaking with respect to the pinion inner part 71.

A pinion spring 11 configured to surround the outer circumferential surface of the pinion inner part 71 is put in the housing unit 76. The pinion spring 11 put in the housing unit 76 is compressed and deformed by the step difference section 74*c* of the diameter-enlarged section 75 of the pinion gear 74 and the step difference section 71*a* of the pinion inner part 71. Accordingly, the pinion gear 74 is biased toward the ring gear 23 with respect to the pinion inner part 71.

As will be described below, the pinion spring 11 functions as a damper mechanism configured to absorb an impact as the pinion spring 11 is elastically deformed in the axial direction when the pinion gear 74 abuts the ring gear 23. Accordingly, wear between the pinion gear 74 and the ring gear 23 is suppressed, and durability of the starter 1 is improved.

Furthermore, a snap ring 77 is formed at the outer circumferential surface of the one side (the left side of FIG. 1) of the pinion inner part 71. Accordingly, withdrawal of the pinion gear 74 to one side of the output shaft 4 with respect to the pinion inner part 71 is restricted.

(Electromagnetic Device)

A yoke 25 that configures the electromagnetic device 9 is fixed at the inner circumferential surface of the housing 17 closer to the motor unit 3 than the clutch mechanism 5. The yoke 25 is formed in a tubular shape having a bottom section 25*a* which is formed of a ferromagnetic material, and a large portion of a center in a radial direction of the bottom section 25*a* is largely opened. Furthermore, an annular plunger holder 26 formed of a ferromagnetic material is formed at an end of the yoke 25 opposite to the bottom section 25*a*.

An exciting coil 24 formed in a substantially cylindrical shape is put in an accommodating concave section 25*b* formed inside in the radial direction by the yoke 25 and the plunger holder 26. The exciting coil 24 is electrically connected to an ignition switch (not shown) via a connector (not shown).

A plunger mechanism 37 is installed at an aperture between the inner circumferential surface of the exciting coil 24 and the outer circumferential surface of the output shaft 4 to be slidable with respect to the exciting coil 24 in the axial direction.

The plunger mechanism 37 has a substantially cylindrical switch plunger 27 formed of a ferromagnetic material and a gear plunger 80 disposed in an aperture between the switch plunger 27 and the outer circumferential surface of the output shaft 4. The switch plunger 27 and the gear plunger 80 are installed concentrically with each other and relatively movably installed in the axial direction. Furthermore, a switch return spring 27*a* formed of a flat spring material configured to bias the plunger holder 26 and the switch plunger 27 in a separating direction is disposed between the plunger holder 26 and the switch plunger 27.

An outer flange section 29 is formed at an end of the switch plunger 27 near the motor unit 3. A switch shaft 30 is stood up at the outer circumferential section side of the outer flange section 29 via a holder member 30*a* in the axial direction. The switch shaft 30 passes through the top plate 12 of the motor unit 3 and a brush holder 33 (to be described below). The movable contact plate 8 of the switch unit 7 disposed near the commutator 61 of the brush-attached direct current motor 51 is connected to an end section protruding from the top plate 12 of the switch shaft 30.

The movable contact plate 8 is floatingly supported by a switch spring 32 while being slidably attached with respect to the switch shaft 30 in the axial direction. Then, the movable contact plate 8 is configured to approach and be separated from a fixed contact plate 34 of the switch unit 7 fixed to the brush holder 33 (to be described below).

The fixed contact plate 34 is configured to be divided into a first fixed contact plate 34*a* disposed at the inside in the radial direction near the commutator 61 with the switch shaft 30 sandwiched therebetween, and a second fixed contact plate 34*b* disposed at the outside in the radial direction opposite to the commutator 61. The movable contact plate 8 abuts the first fixed contact plate 34*a* and the second fixed contact plate 34*b* to straddle them. As the movable contact plate 8 abuts the first fixed contact plate 34*a* and the second fixed contact plate 34*b*, the first fixed contact plate 34*a* and the second fixed contact plate 34*b* are electrically connected to each other.

Furthermore, a ring member 28 configured to abut and be separated from the gear plunger 80 (to be described below) is integrally formed with the inner circumferential surface of the switch plunger 27. The ring member 28 is a member configured to initially press the gear plunger 80 toward the ring gear 23 when the switch plunger 27 is moved toward the ring gear 23.

Here, the clutch outer part 18 of the clutch mechanism 5 is biased toward a plunger inner part 81 by the return spring 21. Accordingly, in the stoppage state of the starter 1 (the upper side of the centerline of FIG. 1), the clutch mechanism 5 presses the switch plunger 27 to the other side (the right side of FIG. 1) via the gear plunger 80 and the ring member 28. Accordingly, the movable contact plate 8 is pressed to the other side to be separated from the fixed contact plate 34.

(Gear Plunger)

The gear plunger 80 disposed inside in the radial direction of the switch plunger 27 includes the plunger inner part 81 disposed inside in the radial direction, a plunger outer part 85 disposed outside in the radial direction, and a plunger spring 91 disposed between the plunger inner part 81 and the plunger outer part 85.

(Plunger Inner Part)

Figure 2:
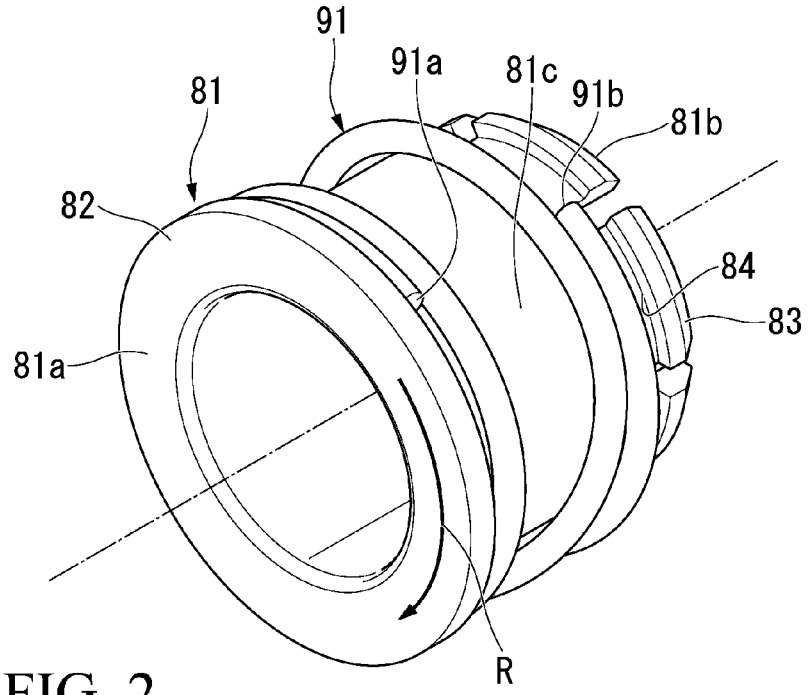
FIG. 2 is a perspective view showing an appearance of a plunger inner part and a plunger spring.

FIG. 2 is a perspective view showing appearances of the plunger inner part 81 and the plunger spring 91.

Figure 3:
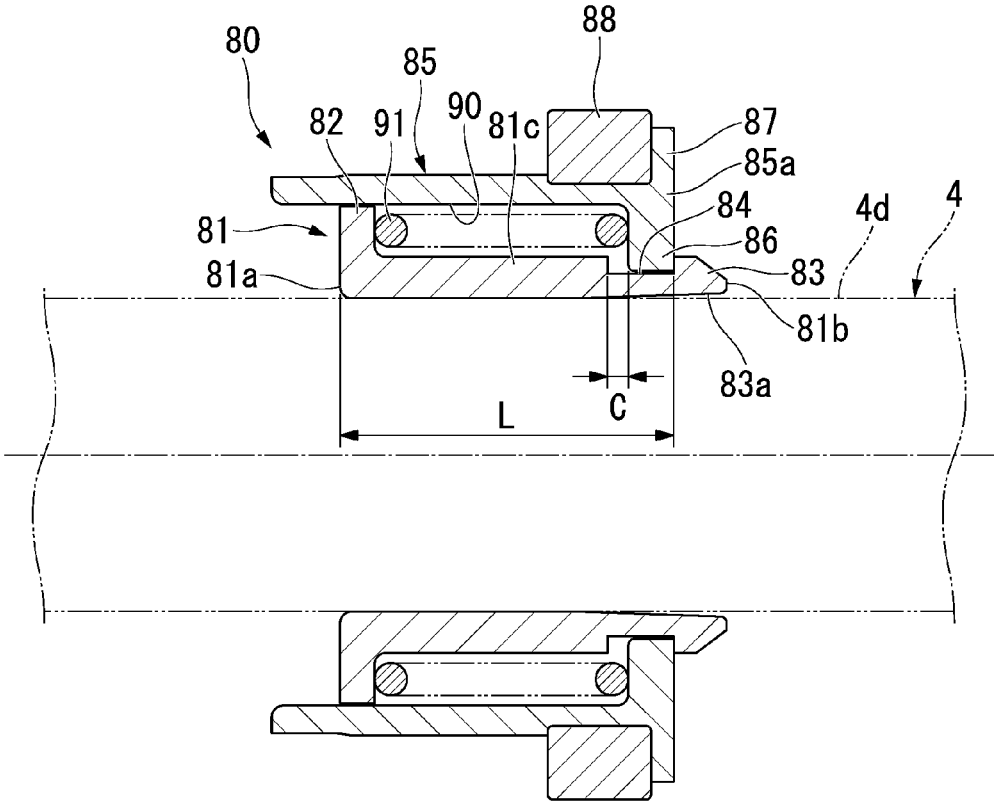
FIG. 3 is a cross-sectional view of a gear plunger along a central axis.

FIG. 3 is a cross-sectional view of the gear plunger 80 along a central axis. In FIG. 3, the output shaft 4 is represented by a two-dot chain line, and parts other than the gear plunger 80 and the output shaft 4 are not shown.

As shown in FIG. 2, the plunger inner part 81 is formed of a resin or the like in a substantially cylindrical shape. As shown in FIG. 3, an inner diameter of a main body section 81*c* of the plunger inner part 81 is slightly larger than a diameter of an outer circumferential surface 4*d* of the output shaft 4 to be fitted onto the output shaft 4. Accordingly, the plunger inner part 81 is slidably installed with respect to the output shaft 4 in the axial direction.

An outer flange section 82 overhanging outward in the radial direction is integrally formed with one end 81*a* (a left side end of FIG. 3) of the plunger inner part 81. When the plunger inner part 81 is slid to one side as will be described below, the one end 81*a* of the plunger inner part 81 abuts the other end (see FIG. 1) of the clutch outer part 18, and slides the clutch mechanism 5 and the pinion mechanism 70 (see FIG. 1) to the one side. That is, the one end 81*a* of the plunger inner part 81 becomes a point of action of the electromagnetic device 9 (see FIG. 1).

A plurality of claw sections 83 having an outer diameter that gradually increases from the other side to the one side (from the right side to the left side of FIG. 3) are formed at the other end 81*b* (the right side end of FIG. 3) of the plunger inner part 81 in the circumferential direction. The plurality of claw sections 83 have flexibility inside in the radial direction. As an inner flange section 86 of the plunger outer part 85 (to be described below) is inserted from the other side to the one side, the plurality of claw sections 83 and the inner flange section 86 of the plunger outer part 85 (to be described below) are configured to be engageable by snap fitting.

A diameter of an inner circumferential surface 83*a* of the claw section 83 is slightly larger than that of the outer circumferential surface 4*d* of the output shaft 4, and the claw section 83 is configured to be fitted onto the output shaft 4 with the main body section 81*c*. Specifically, a gap between the inner circumferential surface 83*a* of the claw section 83 and the outer circumferential surface 4*d* of the output shaft 4 is set to be smaller than a height of the claw section 83.

Furthermore, a groove section 84 is formed at one side (the left side of FIG. 1) of the claw section 83 in the circumferential direction. The inner flange section 86 of the plunger outer part 85 is disposed in the groove section 84.

(Plunger Outer Part)

The plunger outer part 85 is formed of the resin or the like in a substantially cylindrical shape, like the plunger inner part 81. An inner diameter of the plunger outer part 85 is slightly larger than an outer diameter of the outer flange section 82 of the plunger inner part 81. The plunger outer part 85 is fitted onto the plunger inner part 81.

The inner flange section 86 overhanging inward in the radial direction is integrally formed with the other end 85*a* (the right side end of FIG. 3) of the plunger outer part 85. An inner diameter of the inner flange section 86 is set to be smaller than an outer diameter of the claw section 83 of the plunger inner part 81 and to be larger than an outer diameter of a bottom section of the groove section 84 of the plunger inner part 81. Then, as the inner flange section 86 of the plunger outer part 85 is disposed in the groove section 84 of the plunger inner part 81, the plunger inner part 81 and the plunger outer part 85 are integrated to configure the plunger mechanism 37.

Here, a thickness of the inner flange section 86 of the plunger outer part 85 is set to be smaller than a width of the groove section 84 of the plunger inner part 81. Accordingly, a clearance C is formed between the inner flange section 86 of the plunger outer part 85 and the groove section 84 of the plunger inner part 81. Therefore, the plunger inner part 81 and the plunger outer part 85 are configured to be relatively slidable in the axial direction to an extent of the clearance C between the inner flange section 86 of the plunger outer part 85 and the groove section 84 of the plunger inner part 81. Therefore, in the gear plunger 80, a distance between points of action of an outer end surface (an end surface of the left side of the drawing) of the outer flange section 82 of the plunger inner part 81 and an outer end surface (a right side of the drawing) of the plunger outer part 85 is set such that a minimum contraction dimension becomes L-C when a maximum expansion dimension is L.

Furthermore, as described above, a diameter of the inner circumferential surface 83*a* of the claw section 83 of the plunger inner part 81 is set to be slightly larger than that of the outer circumferential surface 4*d* of the output shaft 4. Then, a gap between the inner circumferential surface 83*a* of the claw section 83 and the outer circumferential surface 4*d* of the output shaft 4 is set to be smaller than a height of the claw section 83. For this reason, after the claw section 83 of the plunger inner part 81 and the inner flange section 86 of the plunger outer part 85 are engaged through snap fitting, as the plunger inner part 81 is fitted onto the output shaft 4, the claw section 83 is restricted by the outer circumferential surface 4*d* of the output shaft 4 from being displaced inward in the radial direction to an extent that exceeds the height. Accordingly, release of the engagement of the plunger inner part 81 and the plunger outer part 85 through snap fitting can be securely prevented.

An outer flange section 87 overhanging outward in the radial direction is integrally formed with the other end 85*a* (the right side end of FIG. 3) of the plunger outer part 85. The outer flange section 87 functions as an abutting section configured to abut the ring member 28 of the switch plunger 27.

In addition, a ring-shaped iron core 88 is formed at the outer circumferential surface of the plunger outer part 85, which is one side (a left side of FIG. 3) of the outer flange section 87. For example, the iron core 88 is integrally formed with the plunger outer part 85 by a resin mold. The iron core 88 is attracted by a magnetic flux generated when current is supplied to the exciting coil 24 as will be described below.

(Plunger Spring)

A spring housing unit 90 is formed between the outer flange section 82 of the plunger inner part 81 and the inner flange section 86 of the plunger outer part 85. The plunger spring 91 fitted onto the main body section 81*c* of the plunger inner part 81 and configured to surround the outer circumferential surface of the main body section 81*c* is put in the spring housing unit 90.

The plunger spring 91 is compressed and deformed by the outer flange section 82 of the plunger inner part 81 and the inner flange section 86 of the plunger outer part 85 while being put in the spring housing unit 90. Then, the plunger inner part 81 is biased toward the one side (the left side of FIG. 3) and the plunger outer part 85 is biased toward the other side (the right side of FIG. 3).

Accordingly, as shown in FIG. 1, in the stopped state of the starter 1 (a state of an upper side of a centerline of FIG. 1), the plunger inner part 81 is biased toward the one side (the left side of FIG. 1) and the plunger outer part 85 is biased toward the other side (the right side of FIG. 1) by the plunger spring 91 configuring a backlash absorption mechanism, and the one end 81*a* of the plunger inner part 81 does not abut the other end of the clutch outer part 18. Accordingly, the clutch outer part 18 is pushed to the stopper 94 by a spring load of the return spring 21. Accordingly, in the stopped state of the starter 1, the clutch mechanism 5 is not pushed out by the spring load of the plunger spring 91, i.e., the pinion mechanism 70 is set not to be carelessly pushed out.

Furthermore, in an electrically connected state of the starter 1 (a state of an upper side of the centerline of FIG. 1), when the gear plunger 80 is maximally displaced toward the one side (the left side of FIG. 1), the one end 81*a* of the plunger inner part 81 always abuts the other end of the clutch outer part 18 of the clutch mechanism 5.

That is, the plunger spring 91 configures the backlash absorption mechanism configured to prevent generation of an aperture in the axial direction between the clutch mechanism 5 and the gear plunger 80 and to absorb shaking of the clutch mechanism 5.

Here, provided that a spring load of the plunger spring 91 is $\alpha$ and an attractive force of the electromagnetic device 9 is $\beta$, the spring load $\alpha$ of the plunger spring 91 and the attractive force $\beta$ of the electromagnetic device 9 are set to satisfy the following equation (1).

$$\alpha<\beta \tag{1}$$

As the spring load $\alpha$ of the plunger spring 91 and the attractive force $\beta$ of the electromagnetic device 9 are set to satisfy the equation (1), the gear plunger 80 of the electromagnetic device 9 is attracted to resist the spring load α of the plunger spring 91 configuring the backlash absorption mechanism. Accordingly, the one end 81*a* of the plunger inner part 81 serving as the point of action of the electromagnetic device 9 always elastically abuts the other end of the clutch outer part 18 even upon slide movement of the gear plunger 80.

Further, even when the gear plunger 80 is attracted to be maximally displaced toward the one side (the left side of FIG. 1), the one end 81*a* of the plunger inner part 81 always elastically abuts the other end of the clutch outer part 18. Then, even when the clutch mechanism 5 receives a load in the axial direction by the helical spline 19 upon starting the engine, the attraction state of the gear plunger 80 is not released, and further, displacement of the plunger spring 91 by the spring load can be suppressed. Therefore, displacement in the axial direction of the clutch mechanism 5 can be suppressed by the plunger spring 91.

As the spring load α of the plunger spring 91 and the attractive force β of the electromagnetic device 9 are set to satisfy the equation (1), the clutch mechanism 5 can be suppressed from being shaken in the axial direction while maintaining attraction performance of the electromagnetic device 9.

Furthermore, as shown in FIG. 2, when the plunger spring 91 is concentrically fitted onto the main body section 81*c* of the plunger inner part 81, a winding direction toward the clutch mechanism 5 of the plunger spring 91 (the left side of FIG. 2, see FIG. 1) is set to be equal to a rotation direction R of the pinion mechanism 70.

As the plunger spring 91 is disposed in this way, a direction of an end surface 91*a* of the plunger spring 91 disposed at the clutch mechanism 5 side is disposed to become the same direction as the rotation direction R of the clutch mechanism 5 (see FIG. 1). Furthermore, a direction of an end surface 91*b* of the plunger spring 91 opposite to the above-mentioned side is a direction opposite to the rotation direction R.

Then, a direction toward the end surface 91*a* of the plunger spring 91 becomes the same direction as the rotation direction R of the clutch mechanism 5. For this reason, even when the clutch mechanism 5 and the plunger inner part 81 in sliding contact therewith are rotated with the pinion mechanism 70, a circumferential edge of the end surface 91*a* of the plunger spring 91 can be suppressed from being hooked to the outer flange section 82 of the plunger inner part 81. Therefore, wear of an inner surface side of the outer flange section 82 of the plunger inner part 81 can be prevented by the circumferential edge of the end surface 91*a* of the plunger spring 91.

Furthermore, a direction of the end surface 91*b* of the plunger spring 91 opposite to the above-mentioned side becomes a direction opposite to the rotation direction R. For this reason, even when the plunger spring 91 is dragged to the plunger inner part 81 and rotated, the circumferential edge of the end surface 91*b* of the plunger spring 91 can be suppressed from being hooked by the inner flange section 86 of the plunger outer part 85. Therefore, wear of the inner surface side of the inner flange section 86 of the plunger outer part 85 can be prevented by the circumferential edge of the end surface 91*b* of the plunger spring 91.

As shown in FIG. 1, the brush holder 33 is formed closer to the other side (the right side of FIG. 1) than the electromagnetic device 9 and the planetary gear mechanism 2. Here, a cutting start section 34*c* integrally formed to be bent in the axial direction is formed at the outer circumference side of the second fixed contact plate 34*b*. A shaft terminal 44*a* is configured to pass through an outer wall 33*a* of the brush holder 33 to protrude outward in the radial direction of the starter 1 via an insertion hole of the cutting start section 34*c*. Further, a terminal bolt 44 to which a positive electrode of a battery is electrically connected is attached to a distal end of a protrusion side of the shaft terminal 44*a*. In addition, a cover 45 configured to protect peripheries of the fixed contact plate 34 and the switch shaft 30 is mounted on the brush holder 33. The brush holder 33 and the cover 45 are fixed while sandwiched between the motor yoke 53 and the housing 17. Four brushes 41 are disposed at the brush holder 33 around the commutator 61 to advance and retreat in the radial direction.

A brush spring 42 is installed at a base end side of each of the brushes 41. Each of the brushes 41 is biased toward the commutator 61 and the distal end of the brush 41 comes in slide contact with the segment 62 of the commutator 61 by the brush spring 42.

The four brushes 41 are configured of two positive-electrode-side brushes and two negative-electrode-side brushes, and the two positive-electrode-side brushes are connected to the first fixed contact plate 34*a* of the fixed contact plate 34 via a pigtail (not shown). A positive electrode of the battery (not shown) is electrically connected to the second fixed contact plate 34*b* of the fixed contact plate 34 via the terminal bolt 44.

That is, when the movable contact plate 8 abuts the fixed contact plate 34, a voltage is applied to the two positive-electrode-side brushes of the four brushes 41 via the terminal bolt 44, the fixed contact plate 34, and the pigtail (not shown) to supply current to the coil 59.

Furthermore, the two negative-electrode-side brushes of the four brushes 41 are connected to the ring-shaped center plate via the pigtail (not shown). Then, the two negative-electrode-side brushes of the four brushes 41 are electrically connected to the negative electrode of the battery via the center plate, the housing 17, and the vehicle body (not shown).

(Operation of Starter)

Next, an operation of the starter 1 will be described with reference to the accompanying drawings.

As shown in a state of the upper side of the centerline of FIG. 1, while the starter 1 is stopped before the current is supplied to the exciting coil 24, the clutch outer part 18 biased to the return spring 21 is fully biased toward the motor unit 3 (the right side of FIG. 1) in a state in which the clutch inner part 22 integrated with the pinion gear 74 is pulled. Then, the clutch outer part 18 of the clutch mechanism 5 is stopped at a position abutting the stopper 94, and engagement between the pinion gear 74 and the ring gear 23 is released.

In the stopped state of the starter 1, the plunger inner part 81 is biased toward the one side (the left side of FIG. 1) and the plunger outer part 85 is biased toward the other side (the right side of FIG. 1) by the plunger spring 91 that configures the backlash absorption mechanism, and a distance between the points of action of the gear plunger 80 becomes a maximum expansion dimension L. Here, a clearance is slightly formed between the one end 81*a* of the plunger inner part 81 and the other end of the clutch outer part 18. Accordingly, the clutch outer part 18 is pushed to the stopper 94 by the spring load of the return spring 21. Accordingly, in the stopped state of the starter 1, the clutch mechanism 5 is not pushed by the spring load of the plunger spring 91, i.e., the pinion mechanism 70 is set not to be carelessly pushed toward the ring gear 23.

Furthermore, the switch plunger 27 is returned by the switch return spring 27*a*, and fully moved toward the motor unit 3 (the right side of FIG. 1). Then, the outer flange section 29 of the switch plunger 27 is stopped while abutting the top plate 12. Further, the movable contact plate 8 of the switch shaft 30 stood up on the outer flange section 29 is spaced apart from the fixed contact plate 34 and electrically cut.

Figure 4A:
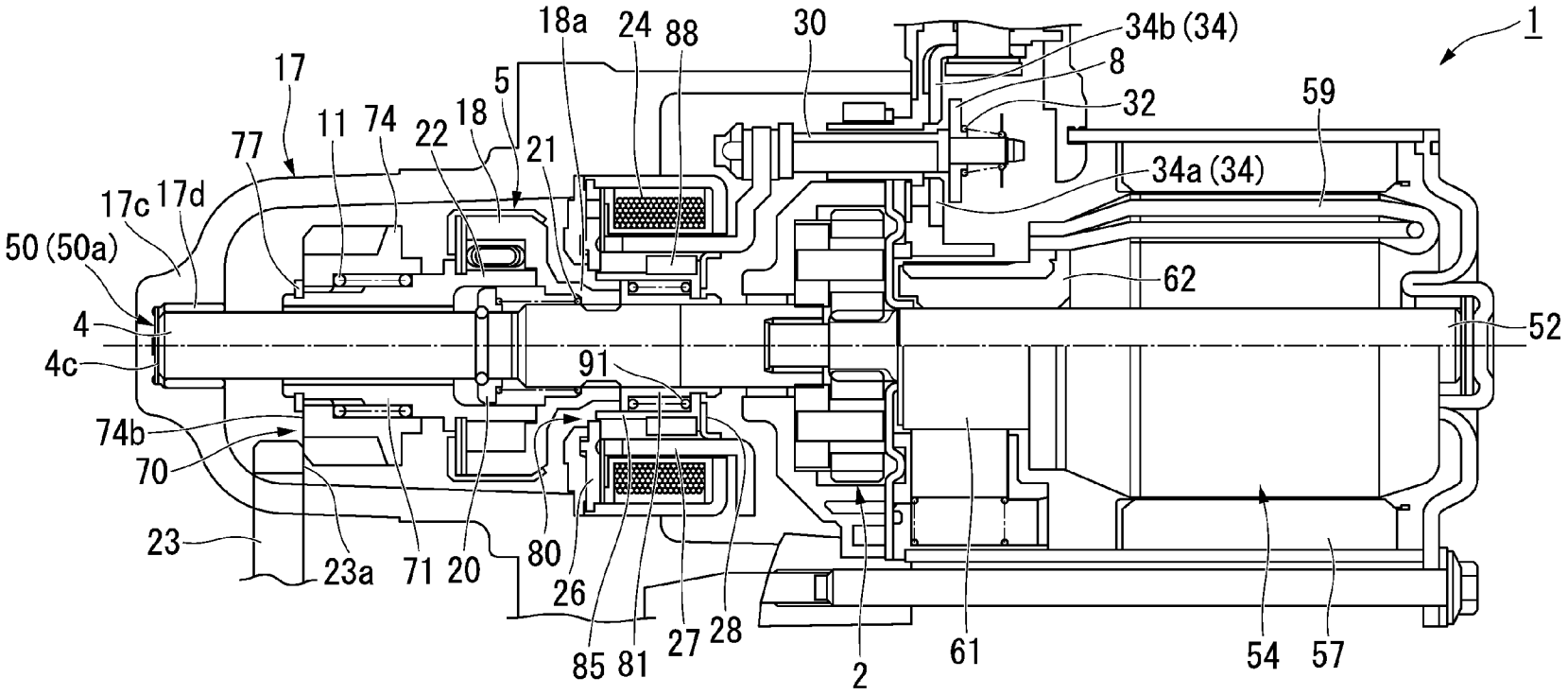
FIG. 4A is a view showing an operation of the starter, for describing a switch plunger immediately after movement.
Figure 4B:
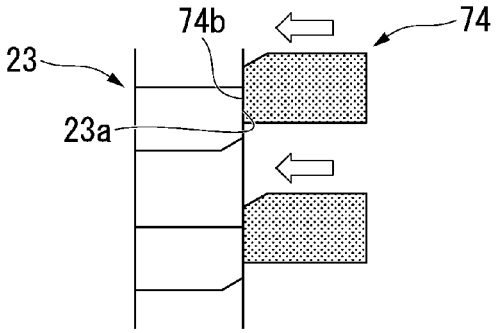
FIG. 4B is a view showing an operation of a pinion gear, for describing the switch plunger immediately after movement.

FIGS. 4A and 4B are views for describing the switch plunger 27 approximately after movement. FIG. 4A is a view for describing an operation of the starter 1. FIG. 4B is a view for describing an operation of the pinion gear 74. Further, FIG. 4B is a schematic view when the pinion gear 74 and the ring gear 23 are seen in the radial direction.

When an ignition switch (not shown) of the vehicle is turned on from this state, the current is supplied to the exciting coil 24 to be excited, and a magnetic path along which a magnetic flux passes the switch plunger 27 and the gear plunger 80 is formed. Accordingly, as shown in FIG. 4A, the switch plunger 27 and the gear plunger 80 slide toward the ring gear 23 (the left side of FIGS. 4A and 4B).

As shown in FIG. 1, in the stopped state of the starter 1, the gap (the clearance in the axial direction) between the switch plunger 27 and the plunger holder 26 is set to be smaller than the gap (the clearance in the axial direction) between the iron core 88 of the gear plunger 80 and the plunger holder 26. For this reason, the attractive force generated from the switch plunger 27 is larger than that generated from the gear plunger 80. For this reason, the switch plunger 27 is configured to slide before the gear plunger 80.

Here, the ring member 28 is integrally formed with the inner circumferential surface of the switch plunger 27. For this reason, as the ring member 28 pushes the gear plunger 80 and the gear plunger 80 is initially pressed toward the ring gear 23, the switch plunger 27 and the gear plunger 80 are integrated and slid toward the ring gear 23.

Furthermore, the output shaft 4 is helically spline-fitted to the clutch outer part 18. Then, the sleeve 18*a* abuts the plunger inner part 81 of the gear plunger 80. Here, an inclination angle between the helical spline 19 of the output shaft 4 and the helical spline 18*b* of the clutch outer part 18 is set to, for example, about 16 degrees with respect to the axial direction. Therefore, as shown in FIG. 4A, the clutch outer part 18 is pushed with respect to the output shaft 4 to an extent of the inclination angle of the helical spline 18*b* while being slightly relatively rotated when the switch plunger 27 and the gear plunger 80 are slid toward the ring gear 23. Further, the pinion mechanism 70 is also interlocked with slide movement of the gear plunger 80 via the clutch mechanism 5 and pushed toward the ring gear 23.

Here, as described above, the spring load $\alpha$ of the plunger spring 91 and the attractive force $\beta$ of the electromagnetic device 9 are set to satisfy the equation (1).

Therefore, the gear plunger 80 is attracted to resist the spring load $\alpha$ of the plunger spring 91 to be slid toward the one side (the left side of FIG. 4B). Accordingly, the one end 81*a* of the plunger inner part 81 serving as the point of action of the electromagnetic device 9 always elastically abuts the other end of the clutch outer part 18 upon slide movement of the gear plunger 80.

Here, as shown in FIG. 4B, the pinion gear 74 moves a predetermined distance toward the ring gear 23. Then, one end surface 74*b* of the one side (the left side of FIG. 4B) of the pinion gear 74 abuts an end surface 23*a* of the other side (the right side of FIG. 4B) of the ring gear 23, or a dimensional distance in the axial direction therebetween becomes zero.

Figure 5A:
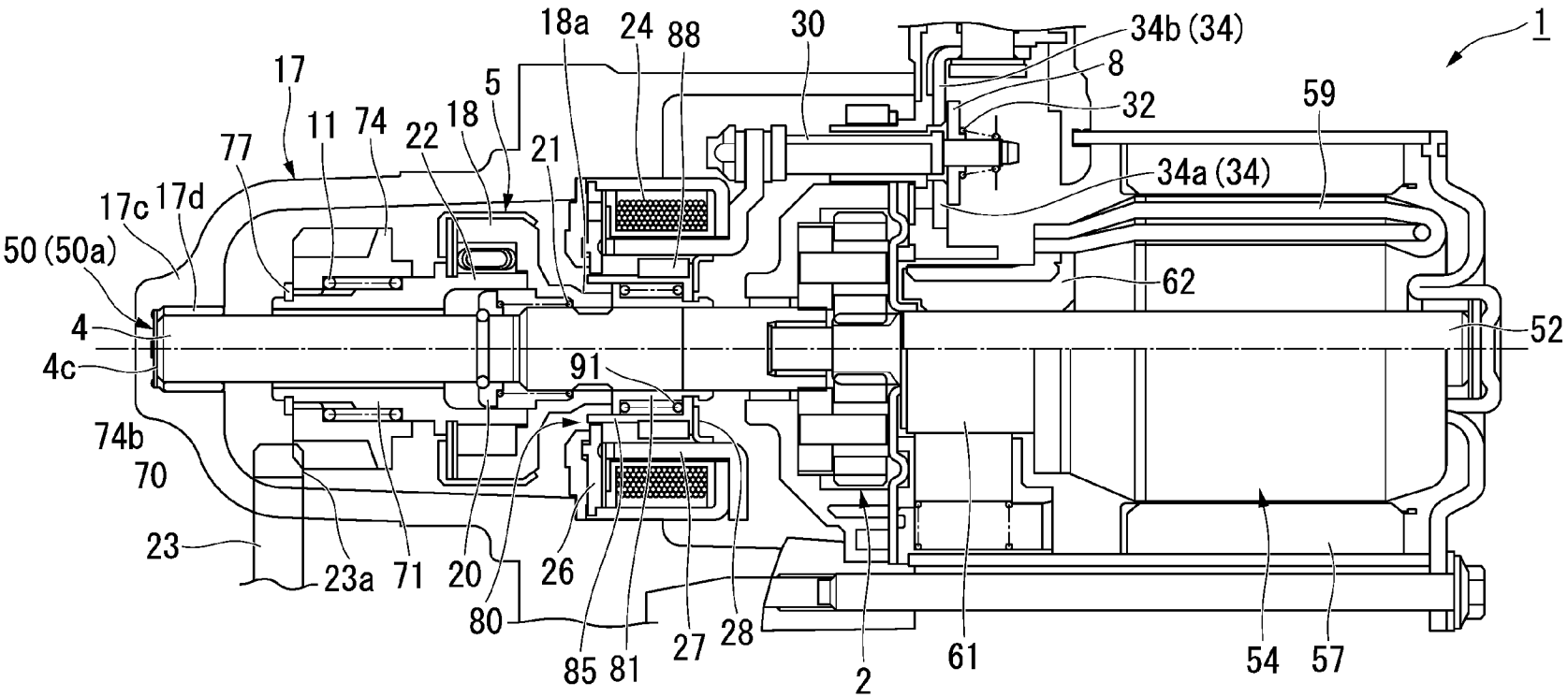
FIG. 5A is a view showing the operation of the starter, for describing the operation when a movable contact plate abuts a fixed contact plate.
Figure 5B:
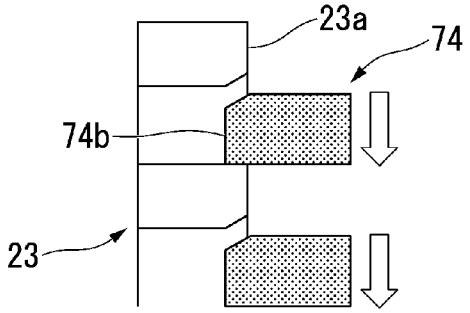
FIG. 5B is a view showing the operation of the pinion gear, for describing the operation when the movable contact plate abuts the fixed contact plate.

FIGS. 5A and 5B are views for describing when the movable contact plate 8 abuts the fixed contact plate 34. FIG. 5A is a view for describing an operation of the starter 1. FIG. 5B is a view for describing an operation of the pinion gear 74.

When the switch plunger 27 is further attracted to be slid toward the ring gear 23, as shown in FIG. 5A, the movable contact plate 8 abuts the fixed contact plate 34. The movable contact plate 8 is floatingly supported with respect to the switch shaft 30 to be displaced in the axial direction. For this reason, the pressing force of the switch spring 32 is applied to the movable contact plate 8 and the fixed contact plate 34.

Here, the one end surface 74*b* of the pinion gear 74 abuts the other end surface 23*a* of the ring gear 23, or a dimensional distance in the axial direction therebetween becomes zero (see FIG. 4B). For this reason, when the end surface 74*b* of the one side of the pinion gear 74 abuts the end surface 23*a* of the other side of the ring gear 23, if the pinion mechanism 70 is further pushed by the switch plunger 27, the pinion spring 11 is contracted. Accordingly, the end surface 74*b* of the one side of the pinion gear 74 is biased toward the end surface 23*a* of the other side of the ring gear 23. That is, the pinion spring 11 configures a damper mechanism configured to absorb shock when the pinion gear 74 abuts the ring gear 23. Accordingly, even in a state in which the end surface 74*b* of the one side of the pinion gear 74 abuts the end surface 23*a* of the other side of the ring gear 23, the switch plunger 27 can be pushed to a predetermined position. Further, wear between the end surface 74*b* of the one side of the pinion gear 74 and the end surface 23*a* of the other side of the ring gear 23 can be suppressed, and durability of the starter 1 can be improved.

Here, as absorption of the shock is performed by the pinion spring 11 as described above and prevention of the shaking of the clutch mechanism 5 is performed by the plunger spring 91, functions of the pinion spring 11 and the plunger spring 91 are separated. Therefore, an elastic modulus of each of the pinion spring 11 and the plunger spring 91 can be optimally set.

Next, as shown in FIG. 5A, when the movable contact plate 8 comes in contact with the fixed contact plate 34, the voltage of the battery (not shown) is applied to the two positive-electrode-side brushes of the four brushes 41, and electricity flows through the coil 59 via the segment 62 of the commutator 61.

Then, a magnetic field is generated from the armature core 58, and a magnetic attractive force or repulsive force is generated between the magnetic field and the permanent magnet 57 installed at the motor yoke 53. Accordingly, the armature 54 starts to rotate. Then, a rotational force of the rotary shaft 52 of the armature 54 is transmitted to the output shaft 4 via the planetary gear mechanism 2, and the output shaft 4 starts to rotate.

When the output shaft 4 starts to rotate, the abutting state (see FIG. 4B) is released when the one end surface 74*b* of the pinion gear 74 abuts the other end surface 23*a* of the ring gear 23. Then, as shown in FIG. 5B, the pinion gear 74 is pushed toward the ring gear 23 by the biasing force of the pinion spring 11, and the pinion gear 74 and the ring gear 23 start to be engaged.

Figure 6A:
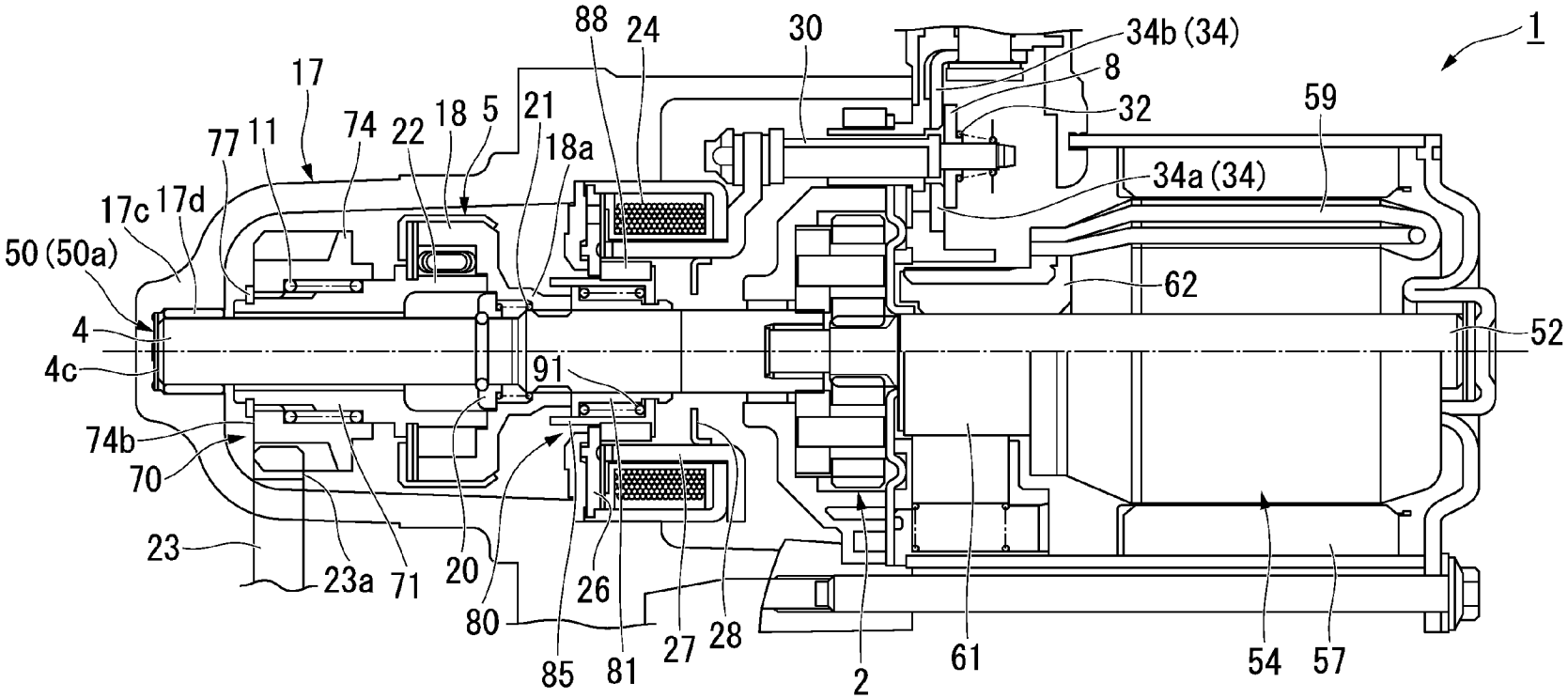
FIG. 6A is a view showing the operation of the starter, for describing the operation when the pinion gear is meshed with the ring gear.
Figure 6B:
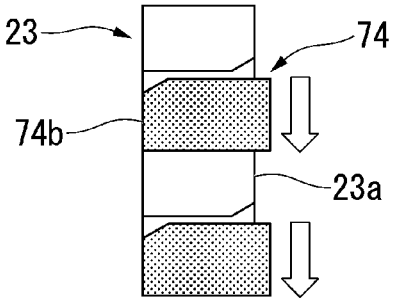
FIG. 6B is a view showing the operation of the pinion gear, for describing the operation when the pinion gear is meshed with the ring gear.

FIGS. 6A and 6B are views for describing when the pinion gear 74 and the ring gear 23 are engaged. FIG. 6A is a view for describing an operation of the starter 1. FIG. 6B is a view for describing an operation of the pinion gear 74.

When the rotational speed of the output shaft 4 is increased, an inertial force is applied to the clutch outer part 18 engaged with the helical spline 19 of the output shaft 4. Here, as described above, as the pinion gear 74 and the ring gear 23 are helically engaged, a thrust force in a direction of the ring gear 23 (a jump-in direction) is generated at the pinion gear 74. For this reason, the pinion gear 74 is moved by the thrust force toward the ring gear 23 (the left side of FIGS. 6A and 6B) against the biasing force of the return spring 21 along the helical spline 19. Furthermore, as shown in FIG. 6A, the clutch outer part 18 is also pushed by the inertial force toward the ring gear 23 (the left side of FIGS. 6A and 6B) against the biasing force of the return spring 21 along the helical spline 19.

Here, an attractive force toward the ring gear 23 is applied to the gear plunger 80. Therefore, the gear plunger 80 is slid toward the ring gear 23 while pressing the clutch outer part 18 to be interlocked with slide movement of the clutch outer part 18.

Accordingly, as shown in FIG. 6B, the pinion gear 74 and the ring gear 23 are engaged at a predetermined engagement position.

Here, upon cranking when the engine starts, a rotational speed of the ring gear 23 is likely to vary.

In particular, in the vehicle including the idle stop function, stoppage and starting of the engine are frequently repeated, and a frequency of use is increased more than that of a general starter. For this reason, variations in rotational speed of the ring gear 23 frequently occur.

Here, since the pinion gear 74 and the ring gear 23 are helically engaged, when a rotational speed difference is generated between the pinion gear 74 and the ring gear 23, a direction of the thrust load applied to the pinion gear 74 is varied, and the pinion gear 74 is displaced in the axial direction. Specifically, when the rotational speed of the ring gear 23 is lower than that of the pinion gear 74, the thrust load toward the ring gear 23 is applied to the pinion gear 74, and the pinion gear 74 is displaced toward the ring gear 23. The thrust load generated at the pinion gear 74 is transmitted to the snap ring 77 installed at the one side of the pinion gear 74, and then transmitted to the output shaft 4 via the pinion inner part 71, the clutch inner part 22, the clutch outer part 18, the movement restriction section 20, and the circlip 20*a*. For this reason, the thrust load toward the one side (the left side of FIGS. 6A and 6B) is generated at the output shaft 4, and slid toward the one side. Furthermore, when the rotational speed of the ring gear 23 is higher than that of the pinion gear 74, the thrust load toward an opposite side of the ring gear 23 is applied to the pinion gear 74, and the pinion gear 74 is displaced toward the opposite side of the ring gear 23.

From this state, when the rotational speed of the previous ring gear 23 is lower than that of the pinion gear 74 and the pinion gear 74 is rotated with the rotational force of the armature 54, if there is backlash between the gear plunger 80 and the clutch mechanism 5, the clutch mechanism 5 is displaced to an extent of the backlash in the axial direction. For this reason, transmission of the rotational force of the armature 54 to the pinion gear 74 is slightly delayed to that extent. Further, since the load applied to the rotation of the armature 54 is also reduced while the clutch mechanism 5 is moved to the extent of the backlash, the rotation of the armature 54 starts to accelerate. However, when the backlash is blocked, the load is applied to the rotation of the armature 54 and the acceleration state transitions to a constant speed state. According to the variation of the state, irregularity may occur at the rotation of the armature 54, and gear engagement sound between the gears of the planetary gear mechanism 2 may be generated by the irregularity of the rotation.

However, the gear plunger 80 includes the plunger spring 91 that constitutes the backlash absorption mechanism. Therefore, even when the clutch mechanism 5 is displaced in the axial direction upon starting the engine, the plunger spring 91 is elastically deformed in a state in which the one end 81*a* of the plunger inner part 81 abuts the other end (see FIG. 1) of the clutch outer part 18. For this reason, the clutch mechanism 5 can be suppressed from being shaken in the axial direction.

When the engine is started and the rotational speed of the pinion gear 74 is more than that of the output shaft 4, a one-way clutch function of the clutch mechanism 5 is applied and the pinion gear 74 idles. In addition, when application of an electric current to the exciting coil 24 is stopped according to the starting of the engine, the pinion gear 74 is separated from the ring gear 23 by the biasing force of the return spring 21 with respect to the clutch outer part 18, and the movable contact plate 8 is spaced apart from the fixed contact plate 34 to stop the brush-attached direct current motor 51.

Effects

According to the embodiment, since the backlash absorption mechanism configured to always elastically abut the one end 81*a* of the plunger inner part 81 serving as the point of action of the electromagnetic device 9 and the clutch mechanism 5 is installed, generation of the aperture between the one end 81*a* of the plunger inner part 81 and the clutch mechanism 5 can be prevented. Accordingly, upon starting the engine, even when the pinion gear 74 is displaced in the axial direction by the rotational speed difference between the ring gear 23 and the pinion gear 74, the clutch mechanism 5 can be suppressed from being shaken in the axial direction. Therefore, generation of noises by the displacement in the axial direction of the clutch mechanism 5 can be prevented.

Furthermore, according to the embodiment, since the pinion mechanism 70 includes the pinion spring 11, shock can be absorbed when the pinion gear 74 abuts the ring gear 23. Therefore, wear between the pinion gear 74 and the ring gear 23 can be suppressed, and durability of the starter 1 can be improved.

Furthermore, as absorption of the shock is performed by the pinion spring 11 and prevention of the shaking is performed by the plunger spring 91 serving as the backlash absorption mechanism, functions of the pinion spring 11 and the plunger spring 91 are separated. For this reason, elastic moduli of the pinion spring 11 and the plunger spring 91 can be optimally set. Accordingly, the starter 1 having good durability and silence can be obtained.

Reference Example

Figure 7:
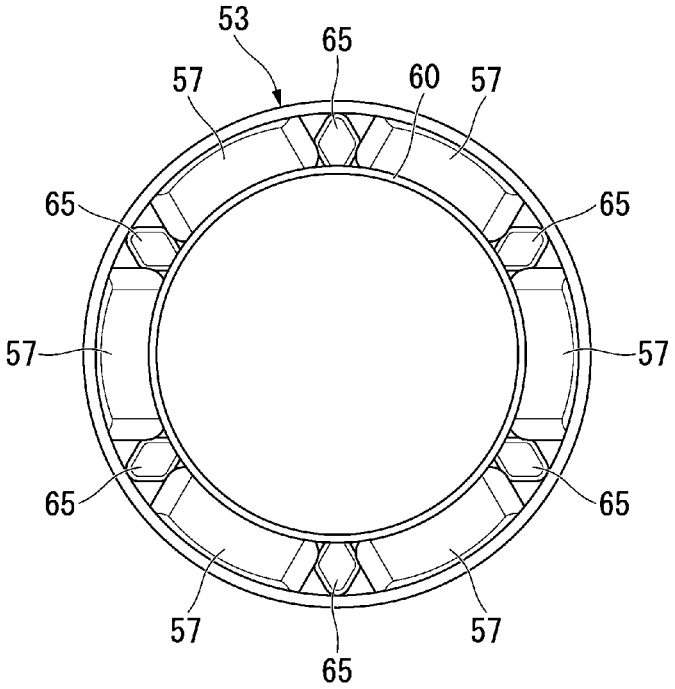
FIG. 7 is a cross-sectional view of a yoke unit perpendicular to an axial direction, for describing a reference example.

FIG. 7 is a view for describing a reference example, showing a cross-sectional view perpendicular to the axial direction of the yoke unit.

As shown in FIG. 7, in the yoke unit configured of the motor yoke 53, the permanent magnet 57 and the magnet cover 60, a vibration control member 65 may be disposed between the plurality of (in the reference example, six) permanent magnets 57 disposed in the circumferential direction at substantial pitches.

The vibration control member 65 is a columnar member having a substantially rectangular cross section, and is formed of an elastic member such as rubber or the like. An outer surface of the vibration control member 65 is formed in, for example, a bellows shape. The vibration control member 65 is disposed to be inserted between the neighboring permanent magnets 57 and 57 in the axial direction. The vibration control member 65 is formed to come in contact with the neighboring permanent magnets 57 and 57, the motor yoke 53 and the magnet cover 60. Accordingly, when the armature 54 (see FIG. 1) is rotated, even when the permanent magnets 57 and 57, the motor yoke 53 and the magnet cover 60 are vibrated, the vibrations can be absorbed by elastic deformation of the vibration control member 65. Therefore, noises caused by the vibrations of the permanent magnets 57 and 57, the motor yoke 53 and the magnet cover 60 can be reduced. In particular, as the above-mentioned vibration control member 65 is applied to the starter 1 including the backlash absorption mechanism of the embodiment, a noise suppression effect by the backlash absorption mechanism can be more remarkably exhibited.

The present invention is not limited to the above-mentioned embodiments but various modifications may be added to the above-mentioned embodiments without departing from the scope of the present invention.

In the embodiment, a so-called uniaxial type starter 1 in which the electromagnetic device 9 includes the exciting coil 24, the plunger mechanism 37 and the switch unit 7, and the plunger mechanism 37 and the output shaft 4 are concentrically disposed has been described.

However, the present invention is not limited to the uniaxial type starter 1 but may be applied to a starter including a configuration in which the pinion mechanism 70 is capable of advancing and retreating. For example, the present invention may be applied to various types of starters such as a so-called biaxial type starter in which the electromagnetic device (the plunger mechanism 37) and the output shaft 4 are disposed on different axes, a so-called triaxial type starter in which the electromagnetic device (the plunger mechanism 37) is disposed on an axis different from that of the rotary shaft 52 and the output shaft 4, or the like.

In the embodiment, the case in which the helical spline 19 is formed at the output shaft 4, the helical spline 18*b* is formed at the clutch outer part 18, the clutch mechanism 5 is helically spline-fitted to the output shaft 4, and thus the clutch mechanism 5 is slidably installed with respect to the output shaft 4 in the axial direction has been described. Here, while the inclination angle between the helical spline 19 of the output shaft 4 and the helical spline 18*b* of the clutch outer part 18 is set to about 16 degrees with respect to the axial direction, the inclination angle is not limited thereto. The inclination angle between the helical spline 19 of the output shaft 4 and the helical spline 18*b* of the clutch outer part 18 with respect to the axial direction may be set such that the clutch outer part 18 is pushed while being slightly relatively rotated with respect to the output shaft 4 when the switch plunger 27 and the gear plunger 80 start to slide toward the ring gear 23.

In the embodiment, the backlash absorption mechanism is configured of the plunger spring 91 formed of a coil spring. However, the backlash absorption mechanism is not limited to the case in which the plunger spring is formed of the coil spring, but the backlash absorption mechanism may be configured using, for example, a flat spring or the like.

In the embodiment, the electromagnetic device 9 having the shaking absorption mechanism is applied to the starter 1 including the pinion mechanism 70 having the damper mechanism. However, the electromagnetic device 9 having the shaking absorption mechanism may be applied to the starter 1 including a pinion mechanism having no damper mechanism. However, the starter 1 of the embodiment is more preferable in that a shock when the pinion gear 74 abuts the ring gear 23 can be absorbed, and wear between the pinion gear 74 and the ring gear 23 can be suppressed, or elastic moduli of the damper mechanism and the shaking absorption mechanism can be optimally set.

In the embodiment, the end surface 91*a* of the plunger spring 91 disposed at the clutch mechanism 5 side (the left side of FIG. 1) is disposed to face in the rotation direction R of the pinion mechanism 70, and wear of the outer circumferential surface of the plunger inner part 81 by the circumferential edge of the end surface 91*a* of the plunger spring 91 is prevented. In addition, the end section in the axial direction of the plunger spring 91 may be cut to form a flat surface, and may be formed such that the end section in the axial direction of the plunger spring 91 and the outer flange section 82 of the plunger inner part 81 come in surface contact with each other. Accordingly, a contact area between the end section in the axial direction of the plunger spring 91 and the outer flange section 82 of the plunger inner part 81 is increased to reduce a surface pressure. For this reason, wear of the plunger inner part 81 can be further prevented. Accordingly, the starter 1 having better durability can be obtained.

In the embodiment, the starter 1 used for starting of the automobile is exemplarily described. However, the starter 1 is not limited to an automobile but may be applied to, for example, a motorcycle or the like.

Furthermore, as described above, the starter 1 of the embodiment includes a structure in which the backlash absorption mechanism configured of the plunger spring 91 is installed at the electromagnetic device 9 and shaking of the clutch mechanism 5 upon starting the engine is suppressed. Accordingly, even in the automobile to which the starter 1 is applied, in particular, the present invention can be appropriately applied to the automobile including the stop-start system having a high frequency of use of the starter 1.

INDUSTRIAL APPLICABILITY

According to the above-mentioned starter, since the backlash absorption mechanism configured to bring the point of action of the electromagnetic device in constant elastic contact with the clutch mechanism is installed, generation of the aperture between the point of action of the electromagnetic device and the clutch mechanism can be prevented. Accordingly, upon starting the engine, even when the pinion mechanism is displaced in the axial direction by the rotational speed difference between the ring gear and the pinion mechanism, the clutch mechanism can be suppressed from being shaken in the axial direction. Accordingly, generation of noises caused by displacement in the axial direction of the clutch mechanism can be prevented.

REFERENCE SIGNS LIST

1 starter
3 motor unit
4 output shaft
5 clutch mechanism
9 electromagnetic device
11 pinion spring
18 clutch outer part
22 clutch inner part
23 ring gear
24 exciting coil

70 pinion mechanism
71 pinion inner part
74 pinion gear
80 gear plunger
81*a* one end of plunger inner part (point of action)
83 claw section
85 plunger outer part
86 inner flange section of plunger outer part
90 spring housing unit
91 plunger spring (backlash absorption mechanism)

The invention claimed is:

1. A starter comprising:

a motor unit configured to generate a rotational force by conducting electricity;

an output shaft configured to receive the rotational force of the motor unit and to rotate; a pinion mechanism slidably installed on the output shaft and helically engageable with a ring gear of an engine;

a clutch mechanism installed between the output shaft and the pinion mechanism and configured to transmit the rotational force of the output shaft to the pinion mechanism; and an electromagnetic device configured to perform conducting electricity and blocking electricity to the motor unit and to bias a pressing force toward the ring gear to the clutch mechanism and the pinion mechanism, and having an exciting coil and a gear plunger sliding in the output shaft direction based on electricity connected to the exciting coil and configured to bias the pressing force to the clutch mechanism, wherein:

the pinion mechanism comprises a pinion inner part fitted onto the output shaft and slidable along the output shaft, the clutch mechanism comprises a clutch outer part disposed at the gear plunger side, and a clutch inner part installed inside in the radial direction of the clutch outer part concentrically with the clutch outer part and integrally formed with the pinion inner part, the gear plunger comprises:

a plunger inner part fitted onto the output shaft and slidable along the output shaft;

a plunger outer part separately from the plunger inner part, installed concentrically with the plunger inner part, and interlocked with the plunger inner part to be slidable along the output shaft, outside in the radial direction of the plunger inner part; and a backlash absorption mechanism installed between the plunger inner part and the plunger outer part, the backlash absorption mechanism is installed to elastically contact a point of action of the gear plunger with the clutch outer part constantly installed at the electromagnetic device, the backlash absorption mechanism abuts on the plunger inner part on one side edge of the backlash absorbing mechanism, and abuts on the plunger outer part on the other side edge of the backlash absorbing mechanism, the pinion mechanism comprises:

a pinion gear concentrically installed with the pinion inner part and helically engageable with the ring gear, outside in a radial direction of the pinion inner part; and a pinion spring disposed between the pinion inner part and the pinion gear, and configured to absorb shock when the pinion gear and the ring gear are helically engaged, the gear plunger is concentrically installed with the output shaft, slidable along the output shaft based on conducting electricity to the exciting coil, and configured to bias a pressing force to the clutch mechanism, the point of action is formed at an end section of the gear plunger near the ring gear, and wherein the gear plunger comprises a plunger spring installed between the plunger inner part and the plunger outer part, the plunger outer part is configured to be slidable based on conducting electricity that is delivered to the exciting coil and the plunger inner part is configured to be interlocked with the slide movement of the plunger outer part to be slidable, and the plunger spring functions as the backlash absorption mechanism, provided that a spring load of the plunger spring is a and an attractive force generated at the plunger outer part by a magnetic field generated through conducting electricity to the exciting coil of the electromagnetic device is $\beta$, the spring load $\alpha$, and the attractive force $\beta$ of the electromagnetic device are set to satisfy $\alpha<\beta$, a diameter-enlarged section having a diameter enlarged via a step difference section is formed at an inner circumferential surface of the pinion gear, a housing unit is formed between the pinion inner part and the pinion gear, the pinion spring configured to surround an outer circumferential surface of the pinion inner part is put in the housing unit, and the pinion spring put in the housing unit is compressed and deformed by the step difference section of the diameter-enlarged section of the pinion gear and a step difference section of the pinion inner part, wherein the plunger inner part abuts the clutch outer part and a pressing force is biased to the pinion mechanism via the clutch outer part, an outer flange section is formed at one end of the plunger inner part and an inner flange section is formed at one end of the plunger outer part, the plunger spring is put in a spring housing unit formed between the outer flange section and the inner flange section, and the plunger spring is a coil spring concentrically fitted onto the plunger inner part, and a winding direction of the plunger spring toward the clutch mechanism is set to be the same as a rotation direction of the pinion mechanism, wherein a claw section protruding outward in the radial direction and elastically deformable inward in the radial direction is formed at the plunger inner part at a position corresponding to the inner flange section of the plunger outer part, and the inner flange section is configured to be engageable with the claw section, and a gap between an inner circumferential surface of the claw section and an outer circumferential surface of the output shaft is set to be smaller than a height of the claw section.

2. The starter according to claim 1, wherein the electromagnetic device is formed concentrically with the output shaft.

3. The starter according to claim 1, wherein the electromagnetic device is formed concentrically with the output shaft.

* * * * *